United States Patent [19]

Le Dall et al.

[11] Patent Number: 4,874,328

[45] Date of Patent: Oct. 17, 1989

[54] CONNECTION DEVICE FOR THE MECHANICAL AND ELECTRICAL CONNECTION OF A MULTI-CONDUCTOR CABLE TO A WELL PROBE

[75] Inventors: Jean-Claude Le Dall, route de l'Empereur; Jean-Claude Marchand, Les Millepertuis, both of France

[73] Assignee: Institut Francais du Petrole et Geomecanique, Rueil-Malmaison, France

[21] Appl. No.: 190,153

[22] Filed: May 4, 1988

[30] Foreign Application Priority Data

May 5, 1987 [FR] France ..... 87 06360

[51] Int. Cl.[4] ..... H01R 13/52

[52] U.S. Cl. ..... 439/278; 439/275

[58] Field of Search ..... 439/275, 276, 278, 279, 439/281, 282, 347, 588, 589

[56] References Cited

U.S. PATENT DOCUMENTS

| | | | |
|---|---|---|---|
| 3,963,297 | 6/1976 | Panek et al. | 439/275 |
| 3,970,352 | 7/1976 | Dorrell et al. | 439/276 |
| 4,198,110 | 4/1980 | Wetmore et al. | 239/89 R |
| 4,373,767 | 2/1983 | Cairns | 439/275 |
| 4,673,231 | 6/1987 | McAnulty, Sr. | 439/278 |
| 4,693,534 | 9/1987 | Clark | 439/275 |
| 4,728,296 | 3/1988 | Stamm | 439/275 |
| 4,795,360 | 1/1989 | Newman et al. | 439/278 |

FOREIGN PATENT DOCUMENTS 2266332 10/1975 France .

*Primary Examiner*—P. Austin Bradley

*Attorney, Agent, or Firm*—Antonelli, Terry & Wands

[57] ABSTRACT

The invention concerns a connection device for providing mechanical and electric connection between a multi-conductor cable and a well-probe, comprising a separation disk through which pass a plurality of pins, connected on the probe side to a female electric connector and at the opposite side to a hollow rods connected electrically to the conductors of the cable, an insulating sleeve having an end-piece for fixing the cable, inside which the connections of the rods to the conductors of the cable are made, the sleeve is fitted on the end of the probe body and is fixed thereto by a nut and a lock-nut providing, at the same time, sealed insulation between the inside of the body and the sleeve and interconnection of the electric conductors of the cable with those of the probe.

8 Claims, 1 Drawing Sheet

CONNECTION DEVICE FOR THE MECHANICAL AND ELECTRICAL CONNECTION OF A MULTI-CONDUCTOR CABLE TO A WELL PROBE

BACKGROUND OF THE INVENTION

1. Field of the invention

The invention relates to a connection device for the mechanical and electric connection of well probes to an electric suspension cable.

2. Description of the Prior Art

Measurements in boreholes are made by means of sensors contained generally in one or more probes lowered from a surface installation at the end of an electric suspension cable capable of supporting the weight of the probes and formed of a plurality of electric conductors. One of the probes at least has anchorage arms actuated by jacks. The liquid required for operating the jacks is produced by a hydraulic system generally driven by an electric motor fed from a surface installation via electric conductors of the cable.

Operation of the anchorage arms for immobilizing the probe (or the probes) at a given depth in the well or borehole is controlled by means of solenoid valves connected by one or more conductors to the surface installation. Other electric conductors are used for connecting different sensors contained in the probes to a recording laboratory and in particular the different sensors used for determining the characteristics of the formations of the sub-soil surrounding the borehole.

The requirements of seismic prospection by which it is desired to obtain as rapidly as possible detailed recordings of the seismic profiles lead to using a greater and greater number of sensors and distributing them in an assembly of probes suspended below each other. The different signals from the different sensors are collected by a data acquisition apparatus designed for multiplexing, digitizing and adapting these signals before transmitting them to one or more lines of the cable to the surface seismic laboratory. The data acquisition is coordinated from the seismic laboratory which sends control and synchronization signals to the reception device in the well. The connection of each sensor disposed in a satellite probe with the data acquisition apparatus disposed generally in the main probe is provided by a special conductor.

The different parts of such a spread cable are described for example in the following French patent application Nos.: FR-2 501 380, 2 548 727, 2 564 599, EN 87/04 365 and EN 87/04 677.

The construction of a spread cable thus formed of a set of several probes spaced apart at different depth levels and containing a large number of sensors makes it then necessary to provide a large number of connections not only between the surface recording and control laboratory and the main probe but also between this latter and the different satellite probes.

It is thus necessary to provide electric connectors which are more and more complex for connecting the different probes to the connection cables.

The construction of such connections is all the more delicate since the probes, for the needs of seismic prospection particularly, must be lowered to depths of several kilometers where pressures prevail of several hundred bars and temperatures which may reach 200° to 300° C.

The connection of the cable to the end of the probes is generally provided by means of a sealed passage element formed of a thick dividing wall in the form of a disk made from in insulating material through which pass metal rods extending on each side of the dividing wall.

The rods are welded or crimped on one side to the conductors of the cable and on the opposite side to the conductors inside the probe. The connection zone is defined and isolated, on each side of the dividing wall, by means of a sleeve formed of two half shells brought together so as to grip the cable and the end of the body of the probe and are fixed together.

Seals are disposed between the two half sheels for isolating this cavity and an insulating substance is injected therein. In order to make the connection between the cable and the different conductors inside each probe removable, a multi-pin electric connector is further used disposed in the cavity on one side of the dividing wall. The construction of each interconnection is time-consuming and difficult for this reason. Furthermore, the electric insulation is difficult to maintain when the external hydrostatic pressure becomes very high because of the method of confining the conductors by means of half shells, which do not withstand the entry of water.

The device of the invention overcomes the above drawbacks. It includes electric connection means providing the connection between different electric conductors in the probe and conductors of the multi-conductor cable, and mechanical fixing means for fixing the cable to the end of the well-probe.

SUMMARY OF THE INVENTION

It is characterized in that the electric connection means include a separation disk with a tubular extension and a female electric connector able to penetrate into the tubular extension, the separation disk being provided with sealed passages for a set of pins which are adapted, on one side thereof for plugging on to a set of hollow rods electrically connected to the conductors of the cable and on the opposite side on female pins of the electric female connector, which are electrically connected to the conductors inside the probe, and the mechanical connection means include an annular sleeve having at one end a fitting associated with means for retaining the cable and adapted for receiving at its opposite end the terminal part of the body of the probe which includes cavities capable of containing the separation disk and the female electric connector, the mechanical connection means including fool-proof means and means for securing the annular sleeve to the terminal part of the body of the well-probe, these means making it possible, by drawing the annular sleeve and the terminal part together, to form the correct electrical connection between the disk and the female electric connector and to isolate the inside sealingly from the well.

The use of a one-piece annular sleeve, of a separation disk for sealingly isolating the inside of the body and the sleeve, electric connection means disposed on each side of the separation disk, fool-proof means formed for example by studs positionable in grooves of the disk and of the female electric connector and also the special shape given to the different elements of the device, contribute to simplifying the connection of the electric conductors and make it possible to provide in a single operation at one and the same time securing of the cable, the electric insulation of the body and of the sleeve and the interconnection of the electric conductor of the multi-conductor cable with those of the well-probe.

BRIEF DESCRIPTION OF THE DRAWINGS

Other features and advantages of the device will be clear from reading the description of one embodiment given by way of non limitative example, with reference to the accompanying drawings in which.

DESCRIPTION OF THE PREFERRED EMBODIMENT

Figure 1:
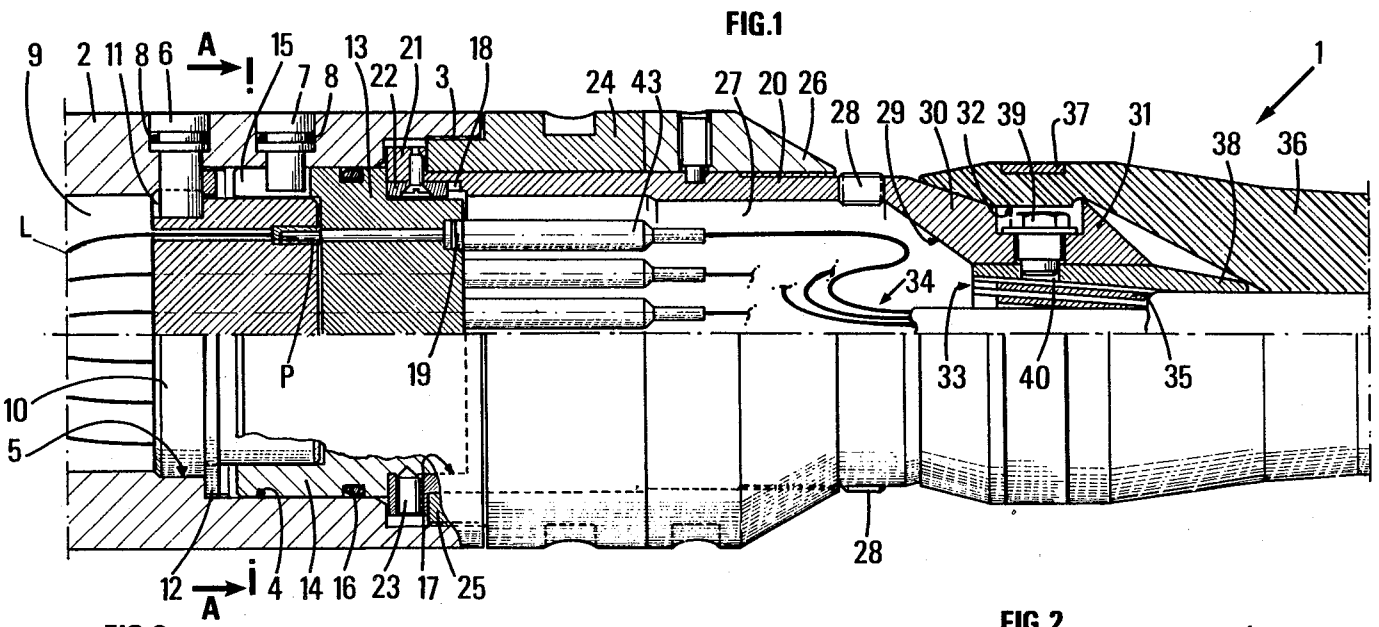
FIG. 1 shows a device for connecting a cable to the terminal part of a probe.

The device is provided for connecting a multi-conductor cable 1 to the end of a well-probe body 2. The end of body 2 is tubular and has a first inner bore 3 with a threaded portion extended by a second bore 4 of a smaller section than the first one and a third bore 5 of a section smaller than that of the second bore.

At the level of the third bore, the tubular wall of the body has passing therethrough three radial housings spaced apart by 120° for three fool-proof studs 6. Similarly, at the level of the second bore 4, the wall of the body has passing therethrough three radial housings also spaced apart by 120° for three other fool-proof studs 7. Studs 6 and 7 are provided with seals 8 and their respective lengths are chosen so that their ends project from the inner wall 9 of body 2.

Figure 3:
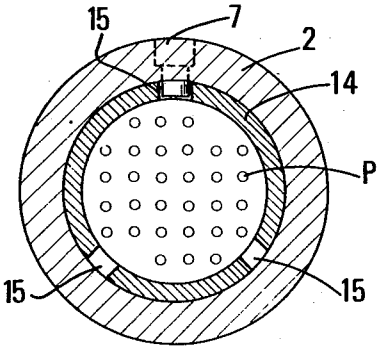
FIG. 3 shows a cross sectional view of the device.

The device comprises a female electric connector 10 of a section adapted to that of the third cavity 5 and of a length greater than this latter. The connector 10 is provided with three longitudinal grooves 11 whose width is adapted to that of the fool-proof studs and are also disposed at 120° from each other. It includes (FIG. 3) a number of female sockets P.

A ring 12 whose section is less than that of the second cavity 4 is fixed about connector 10. The device also includes a separation disk 13 whose external section is adapted to that of the second cavity, this disk having on one side a tubular extension with three longitudinal grooves 15 whose width is adapted to the diameter of the fool-proof studs 7 and are disposed at 120° from each other. The inner section of extension 14 is adapted to the outer section of the female connector 10. A seal 16 is disposed in an annular groove at the periphery of the disk.

On the side opposite the tubular extension 14, the disk is provided with a circular shoulder 17 comprising a longitudinal groove 18. Passages are formed through disk 13 and male pins 19 with seals are fitted therein and pass therethrough from one side to the other. The length of the pins is greater than the thickness of the disk. Their number and arrangement are such that, on the tubular extension side, the male pins are engaged in the different sockets of the female connector 10 when the longitudinal grooves 11 and 15 are in the extension of each other.

The fitting of the pins in the channels passing through the separation disk is designed to prevent any penetration of water at high pressures (greater than 1000 bars for example) and at temperatures of several hundreds of degrees centigrades.

The device also includes an annular sleeve 20 whose inner section, at the side of a first end, is adapted to that of the circular shoulder 17 of disk 13. At this same first end, the sleeve has a collar 21. A fool-proof shim 22, of a width adapted to that of the axial groove 18, is fixed to the inner wall of the sleeve in the vicinity of its first end. A pointed screw 23 passing through the collar makes it possible to immobilize disk 13 in translation with respect to sleeve 20. A nut 24 may slide along the sleeve. It is provided with a tubular extension 25 of an external diameter adapted to that of the first inner bore 3 of body 2 and is externally threaded. The outer wall of sleeve 20 is threaded over a part of its length. A lock-nut 26 in the form of a ring and whose inner wall is threaded may be screwed on the outer thread of sleeve 20.

The inner cavity 27 of the sleeve communicates with the outside through two radial orifices closed by two threaded plugs 28. At its end opposite collar 21, the sleeve has an end-piece 29 for connection to the cable formed of two truncated cones 30, 31 connected together by a cylindrical portion 32. An axial opening 33 is formed in the axis of the end-piece. The cable includes a bundle of lines 34 inside an external truss in the form of a braid 35. The assembly is embedded in an elastomer sealing sheath 36. The end of bevelled portion 38 is fitted under the sheath and a sealing ring 37 is clamped above a the level of the cylindrical portion 32.

A tubular bevelled piece 38 with an opening of a diameter adapted to that of the sheath is disposed in the axial opening 33 of the end-piece. It is pressed against the braid by fitting three clamping screws or pins 39 into three threaded openings 40 formed radially in the end-piece at the level of its cylindrical portion 32.

For safety's sake, the dimensions of these three pins 39 are chosen so that they yield if the axial tractive forces which are exerted on the cable exceed a given value. This safety system is used at the head of the probe if there is only one or else between each probe head and the cable portion which connects it to the probe disposed below, in the case where a string of several interconnected probes are lowered into the well.

Figure 2:
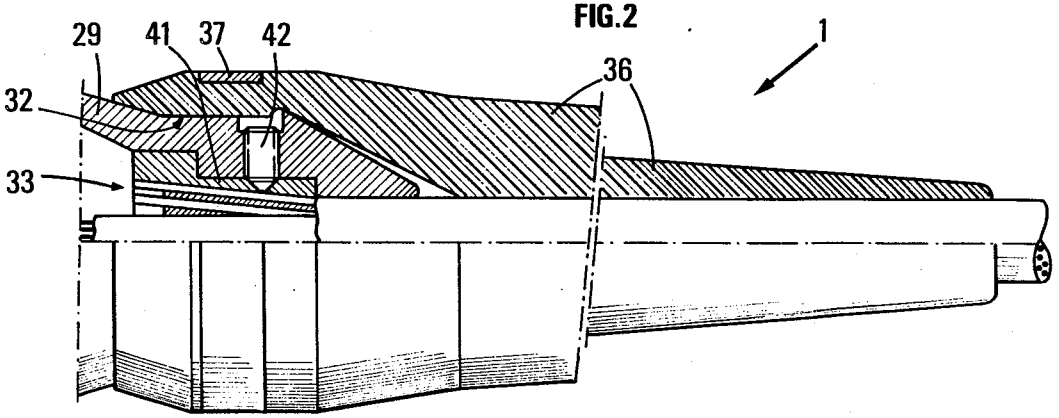
FIG. 2 shows a partial view of the connection device of FIG. 1 showing the variation of the cable retaining means.

In the case of a multi-probe reception device, the cable portion is connected at its end (FIG. 2) to a similar end-piece 29 of another probe which, for operation, is placed thereabove. The method of connection is identical except that the bevelled piece 38 is replaced by a cylindrical piece 41 and the clamping pins 39 by pointed screws 42 engaged in cavities formed in piece 40. The stripping strength obtained is much greater than that offered by the bevel and the pins. The result is that possible breaks always occur at the level of the upper end-piece of each probe.

This is studied so that a part of the device can always be raised should one of the probes be jammed.

Rods 43 are fitted on to the different male pins 19, on the side of disk 13 opposite the female electric connector 10. The ends of the different lines 34 of cable 1 are welded to these rods. Through the openings, a liquid or pasty dielectric substance is introduced for electrically insulating the rods 43 from the humidity which might penetrate inside sleeve 20.

In a preparatory phase, the different conductors L leaving body 2 are connected electrically to the different sockets of the female electric connector 10. The external sheath 36 of the cable to be connected is shortened as well as its braid 35 so as to free a length of the inside cable greater than the length of the sleeve.

After positioning nut 24 and its lock-nut 26 about the sleeve, the cable to be connected is engaged in the opening 33 of the end-piece, its braid 35 is locked by the bevelled piece 38 and the clamping pins 39, then the external sheath is fitted about the cylindrical part of end-piece 29 and clamped by ring 37. The different lines 34 of the cable are then connected electrically to rods 43.

With this preliminary phase finished:

the different pins 18 of disk 13 are fitted into rods 43, the disk is applied against collar 21 of the sleeve in a position making it possible to engage shim 22 in groove 18, the female electric connector 10 is fitted on the pins projecting from disk 13, on the side opposite rods 43 while care is taken to position, in the extension of each other, the two grooves 11, 15 formed respectively in the tubular extension 14 of the disk and in the female electric connector 10.

the already assembled parts are engaged in the end of the body of the probe so that the fool-proof studs 6, 7 coincide with the groove, and nut 24 is tightened in the first threaded bore 3 at the end of the body then the lock-nut 26 so as to interlock the different elements with each other.

To finish, the two plugs 28 are removed from the sleeve and an insulating fluid is injected such as a silicone paste, until the inner cavity 27 is completely filled then they are re-fitted. The electric connection is thus rapidly formed and without any risk of error. Since the connection is achieved by means of a cylindrical sleeve screwed on to the end of the body, a good mechanical rigidity and good electric insulation of the interconnected lines are thus readily obtained.

What is claimed is:

1. A connection device for the electric and mechanical connection of a well-probe to a multi-conductor cable to the end of which the probe is lowered into a well or bore hole, comprising electric connection means for connection between different electric conductors in the well-probe and conductors of the multi-conductor cable and mechanical connection means for fixing the cable to the end of the well probe, wherein the electric connection means comprises a separation disk with a tubular extension and a female electric connector able to penetrate into the tubular extension, the separation disk being provided with sealed passages for a set of pins which are adapted, on one side thereof for plugging on to a set of hollow rods electrically connected to the conductors of the cable and on the opposite side on female pins of the electric female connector, which are electrically connected to the conductors inside the probe, and the mechanical connection means include an annular sleeve having at one end a fitting associated with means for retaining the cable and adapted for receiving at its opposite end a terminal part of a body of the probe which includes cavities capable of containing the separation disk and the female electric connector; the mechanical connection means including fool-proof means cooperating with the separation disk, the female electric connector and the sleeve for a proper angular orientation of the same with respect to one another, and means for securing the annular sleeve to the terminal part of the body of the well-probe, said mechanical connection means acting by drawing the annular sleeve and the terminal part together, to form a correct electrical connection between the disk and the female electric connector and to isolate inside of the body sealingly from the well.

2. The device as claimed in claim 1, wherein the inner cavity of the annular sleeve, between the separation disk and the end-piece, communicates with the outside through openings provided with plugs for introducing a dielectric substance.

3. A connection device for the electric and mechanical connection of a well-probe to a multi-conductor cable to the end of which the probe is lowered into a well or bore hole, comprising electrical connection means for connection between different electric conductors in the well-probe and conductors of the multi-conductor cable and mechanical connection means for fixing the cable to the end of the well probe, wherein the electrical connection means comprises a separation disk with a tubular extension and a female electric connector able to penetrate into the tubular extension, the separation disk being provided with sealed passages for a set of pins which are adapted, on one side thereof for plugging onto a set of hollow rods electrically connected to the conductors of the cable and on the opposite side on female pins of the electric female connector, which are electrically connected to the conductors inside the probe, and the mechanical connection means comprise an annular sleeve having at one end a fitting associated with means for retaining the cable and adapted for receiving at its opposite end a terminal part of a body of the probe which includes cavities capable of containing the separation disk in the female electric connector; the mechanical connection means comprising fool-proof means associated with means for securing the annular sleeve to the terminal part of the body of the well probe, these means acting, by drawing the annular sleeve and the terminal part together, to form a correct electrical connection between the disk and the female electric connector and to isolate the inside of the body sealingly from the well; said annular sleeve indluding a collar on the side opposite an end-piece, said separation disk comprising a part of smaller section adapted for fitting inside the end-piece, on the collar side and said terminal part of the probe body comprising in the extension of each other, several recesses of decreasing sections adapted for receiving, respectively, the female electric connector, the tubular extension of the separation disk and the collar.

4. The device as claimed in claim 3, wherein the securing means comprise a nut slidable over the annular sleeve and whose external wall includes a threaded portion adapted for screwing on to an inner thread of the recess the closest to the end of the body of the probe, and a lock-nut screwable on to an external threaded part of the annular sleeve for moving the nut laterally with respect to the annular sleeve.

5. A connection device for the electric and mechanical connection of a well-probe to a multi-conductor cable to the end of which the probe is lowered into a well or bore hole, comprising electrical connection means for connection between different electric conductors in the well-probe and conductors of the multi-conductor cable and mechanical connection means for fixing the cable to the end of the well probe, wherein the electrical connection means comprises a separation disk with a tubular extension and a female electric connector able to penetrate into the tubular extension, the separation disk being provided with sealed passages for a set of pins which are adapted, on one side thereof for plugging onto a set of hollow rods electrically connected to the conductors of the cable and on the opposite side on female pins of the electric female connector, which are electrically connected to the conductors inside the probe, and the mechanical connection means comprise an annular sleeve having at one end a fitting associated with means for retaining the cable and adapted for receiving at its opposite end a terminal part of a body of the probe which includes cavities capable of containing the separation disk in the female electric connector; the mechanical connection means comprising fool-proof means associated with means for securing the annular sleeve to the terminal part of the body of the well probe, these means acting, by drawing the annular sleeve and the terminal part together, to form a correct electrical connection between the disk and the female electric connector and to isolate the inside of the body sealingly from the well; said fool-proof means comprising studs adapted for engagement in longitudinal grooves formed in the female electric connector and the tubular extension of the separation disk, these studs being solid with the terminal part of the body of the probe and an element solid with the annular sleeve and adapted for engagement in a longitudinal groove also formed in the separation disk.

6. A connection device for the electric and mechanical connection of a well-probe to a multi-conductor cable to the end of which the probe is lowered into a well or bore hole, comprising electrical connection means for connection between different electric conductors in the well-probe and conductors of the multi-conductor cable and mechanical connection means for fixing the cable to the end of the well probe, wherein the electrical connection means comprises a separation disk with a tubular extension and a female electric connector able to penetrate into the tubular extension, the separation disk being provided with sealed passages for a set of pins which are adapted, on one side thereof for plugging onto a set of hollow rods electrically connected to the conductors of the cable and on the opposite side on female pins of the electric female connector, which are electrically connected to the conductors inside the probe, and the mechanical connection means comprise an annular sleeve having at one end a fitting associated with means for retaining the cable and adapted for receiving at its opposite end a terminal part of a body of the probe which includes cavities capable of containing the separation disk in the female electric connector; the mechanical connection means comprising fool-proof means associated with means for securing the annular sleeve to the terminal part of the body of the well probe, these means acting, by drawing the annular sleeve and the terminal part together, to form a correct electrical connection between the disk and the female electric connector and to isolate the inside of the body sealingly from the well, with the multi-conductor cable provided with a resilient material sheath, the mechanical connection means comprising clamping means for compressing said cable inside the end-piece and sealing means for applying the sheath against the external wall of the end-piece.

7. The device as claimed in claim 6, wherein the clamping means include a bevelled locking piece and screws for applying said piece against the multi-conductor cable.

8. The device as claimed in claim 7, wherein the screws are chosen for resisting, within well defined limits, stripping of the multi-conductor cable.

* * * * *